US008659540B2

(12) United States Patent
Wang et al.

(10) Patent No.: US 8,659,540 B2
(45) Date of Patent: Feb. 25, 2014

(54) ELECTRO-PHORETIC DISPLAY HAVING A LIGHT SENSOR FOR ADJUSTING THE BRIGHTNESS OF THE DISPLAY AND METHOD THEREOF

(75) Inventors: Tzu-Ming Wang, Fongshan (TW); Kai-Cheng Chuang, Tainan (TW); Po-Wen Hsiao, Hsinchu (TW)

(73) Assignee: E Ink Holdings Inc., Hsin-chu (TW)

( * ) Notice: Subject to any disclaimer, the term of this patent is extended or adjusted under 35 U.S.C. 154(b) by 314 days.

(21) Appl. No.: 12/752,605

(22) Filed: Apr. 1, 2010

(65) Prior Publication Data

US 2011/0169869 A1 Jul. 14, 2011

(30) Foreign Application Priority Data

Jan. 12, 2010 (TW) ..... 99100736 A

(51) Int. Cl.
*G09G 3/34* (2006.01)

(52) U.S. Cl.
USPC ..... 345/107

(58) Field of Classification Search
USPC ..... 345/107
See application file for complete search history.

(56) References Cited

U.S. PATENT DOCUMENTS

| | | | | |
|---|---|---|---|---|
| 2009/0066635 | A1* | 3/2009 | Hong et al. | 345/107 |
| 2009/0109172 | A1* | 4/2009 | Lee et al. | 345/107 |
| 2009/0289891 | A1* | 11/2009 | Yamaguchi et al. | 345/107 |
| 2010/0149145 | A1* | 6/2010 | Van Woudenberg et al. | 345/207 |

FOREIGN PATENT DOCUMENTS

| | | | |
|---|---|---|---|
| CN | 1878439 | A | 12/2006 |
| TW | 200525268 | A | 8/2005 |
| TW | 200632498 | A | 9/2006 |
| TW | 200705347 | A | 2/2007 |
| WO | WO 2006103597 | * | 10/2006 |

OTHER PUBLICATIONS

CN office action dated Jul. 12, 2013.
Taiwanese Office Action, Taiwanese Patent Application No. 099100736, May 24, 2013, 8 pgs.

* cited by examiner

*Primary Examiner* — Long D Pham
(74) *Attorney, Agent, or Firm* — Volpe and Koenig, P.C.

(57) ABSTRACT

An electro-phoretic display and a brightness adjusting method thereof are provided. The method for adjusting a brightness includes steps of: providing a pixel having a first area displaying a white color and a plurality of first particles corresponding to the first area; obtaining an environmental brightness; and controlling only locations of the plurality of first particles in response to the environmental brightness so as to adjust the brightness.

20 Claims, 5 Drawing Sheets

ELECTRO-PHORETIC DISPLAY HAVING A LIGHT SENSOR FOR ADJUSTING THE BRIGHTNESS OF THE DISPLAY AND METHOD THEREOF

FIELD OF THE INVENTION

The present invention relates to a display and a brightness adjusting method thereof, and more particularly to an electrophoresis display and a brightness adjusting method thereof.

BACKGROUND OF THE INVENTION

An electro-phoretic display is a kind of device often used for electronic papers or the electronic readers, where the locations of black particles and white particles configured therein are adjusted by applying an electric field to form the desired images. The electronic papers could be gray-scale or color displays. The electronic papers have multiple features, such as being able to be bent freely, owning high color contract, high definition, low electric power consumption and low manufacturing cost. The technique relevant to electronic papers is also called e-ink because the final displaying result is quite similar to the displaying shown by ink writing on a real paper and is different from that shown by typical flat panel display. The particles distributed in the electronic papers do not change theirs present locations on the condition that none of additional electric field is applied. Therefore, the pictures or the texts previously demonstrated could be kept on the screen just like a usual paper print for a long period, and the static contents demonstrated on the screen could be still read or watched by a user through the external or environmental light sources without backlight modules used for lightening the pixels.

In the prior art, one of the methods for implementing color electro-phoretic display is to use color filters. Since an electro-phoretic display is a kind of reflective display, and the reflective display itself does not emit light but reflects the external environmental light only, the color filters that allow a specific color light to pass through could be therefore used for controlling the reflected colors. The color electro-phoretic display, like the gray-scale electro-phoretic display, has a plurality of capsules, and there are a plurality of black particles and white particles existing in the plurality of capsules. The color electro-phoretic display has a color filter, and the color filter has a red (R) photoresist area, a green (G) photoresist area, a blue (B) photoresist area and a white (W) photoresist area in one pixel. After passing through the color filter and then entering the color electro-phoretic display, the external light is reflected outwards by the white particles in the capsules, and then passes through the R, G, B and W photoresist areas in the color filter again, to display colors.

Although the goal of displaying colors is achieved by various photoresist areas in the prior art, the brightness of the light is attenuated by the color filter while the light passes through the color filter. The light passes through the color filter when both entering and reflected the color electro-phoretic display, such that the brightness of the reflected light is influenced by the attenuation much significant. In addition, the prior color electro-phoretic display is a kind of reflective display. Therefore, the definition and the comfort thereof are influenced by the environmental light. In the prior art, the brightness could be raised by increasing the number of the white particles approaching the display side (or the display surface), however, the displayed color depth is changed at the same time and the quality of the frame is influenced.

It is therefore attempted by the applicant to deal with the above situation encountered in the prior art.

SUMMARY OF THE INVENTION

An electro-phoretic display and a brightness adjusting method thereof are provided in the present invention. A light sensing element such as a light sensor is used for sensing the environmental brightness, and the brightness of the W photoresist area in a pixel is adjusted so as to determining the brightness of the display. An electric device with an external light sensor for sensing the external environmental brightness is provided in the present application, wherein the light sensor is electrically connected to a control circuit. By the light sensor sensing the external environmental brightness, the control circuit is determined to drive the area displaying the white color in a pixel in order to increase the brightness of the frame in a dark environment. When the environmental brightness is lower than a threshold value, a driving circuit such as the control circuit is triggered to cause more white particles corresponding to the W photoresist area to be raised approaching the display surface. The definition and the comfort for reading provided by the device are improved, and the drawback of the color depth changed by the conventional brightness adjusting method in the prior art is resolved.

In accordance with the first aspect of the present invention, a method for adjusting a brightness is provided. The method includes: providing a pixel having a first area displaying a white color and a plurality of first particles corresponding to the first area; obtaining an environmental brightness; and controlling only locations of the plurality of first particles in response to the environmental brightness so as to adjust the brightness.

Preferably, the pixel has a display side, and the plurality of first particles include at least one white particle and at least one black particle.

Preferably, the step of controlling only locations of the plurality of particles further includes a step of controlling the at least one white particle to approach the display side and the at least one black particle to move away from the display side for reflecting light to human eyes.

Preferably, the step of controlling only locations of the plurality of first particles further includes a step of controlling the at least one white particle to move away from the display side and the at least one black particle to approach the display side for reducing light to human eyes.

Preferably, the pixel further has a second area displaying other colors, and a plurality of red particles, a plurality of green particles and a plurality of blue particles corresponding to the second area.

Preferably, the pixel further has a plurality of capsules, and each of the plurality of capsules has at least one of the plurality of first particles.

In accordance with the second aspect of the present invention, a brightness adjusting method for a display device is provided. The method includes: providing a pixel in the display device with a white photoresist area and a plurality of first particles corresponding to the white photoresist area; and adjusting only locations of the plurality of first particles corresponding to the white photoresist area to control a brightness of the display device.

Preferably, the display device further includes a control circuit, and the step of adjusting only locations of the plurality of first particles is performed by the control circuit.

Preferably, the pixel further has a first and a second electrode layers corresponding to the white photoresist area, and an electrophoresis layer configured therebetween and having the plurality of first particles.

Preferably, the first and the second electrode layers respectively have a first voltage and a second voltage, and the step of adjusting only locations of the plurality of first particles further includes a step of: adjusting one of the first voltage and the second voltage via the control circuit so as to move the plurality of first particles.

Preferably, the display device has a display surface, the plurality of first particles include a plurality of white particles and a plurality of black particles, and the step of adjusting only locations of the plurality of first particles further includes steps of: sensing an environmental brightness; and causing the plurality of white particles to approach the display surface and keeping the plurality of black particles away from the display surface when the environmental brightness is lower than a predetermined value.

In accordance with the third aspect of the present invention, an electro-phoretic display is provided. The electro-phoretic display includes: an area displaying a white color; an electrophoresis layer having a plurality of first particles corresponding to the area; and a brightness controller controlling locations of the plurality of first particles according to an environmental brightness so as to adjust a brightness of the electro-phoretic display.

Preferably, the brightness controller further includes a sensor sensing the environmental brightness.

Preferably, the electro-phoretic display further includes a display side, wherein the plurality of first particles further include a plurality of white particles and a plurality of black particles, and the brightness controller causes the plurality of white particles to approach the display side and keeps the plurality of black particles away from the display side when the environmental brightness is lower than a predetermined value.

Preferably, the electro-phoretic display further includes a color filter having a white photoresist area corresponding to the area.

Preferably, the color filter further has a red photoresist area, a green photoresist area and a blue photoresist area.

Preferably, the white, the red, the green and the blue photoresist areas are respectively squared-shaped.

Preferably, the electrophoresis layer has a plurality of capsules, each of which has at least one of the plurality of first particles.

Preferably, the electro-phoretic display further includes a first and a second electrode layers corresponding to the area, and the electrophoresis layer configured therebetween, wherein the brightness controller controls the locations of the plurality of first particles by adjusting a voltage across the first and the second electrode layers.

Preferably, the electro-phoretic display is an electric paper.

BRIEF DESCRIPTION OF THE DRAWINGS

The foregoing and other features and advantages of the present invention will be more clearly understood through the following descriptions with reference to the drawings, wherein.

DETAIL DESCRIPTION OF THE PREFERRED EMBODIMENT

The present invention will now be described more specifically with reference to the following embodiments. It is to be noted that the following descriptions of preferred embodiments of this invention are presented herein for the purposes of illustration and description only; it is not intended to be exhaustive or to be limited to the precise form disclosed.

The identical numeral reference always represents for the identical element. For example, while the control circuit 2 is referred, it always represents for the control circuit 2 in FIG. 1(A).

Figure 1A:
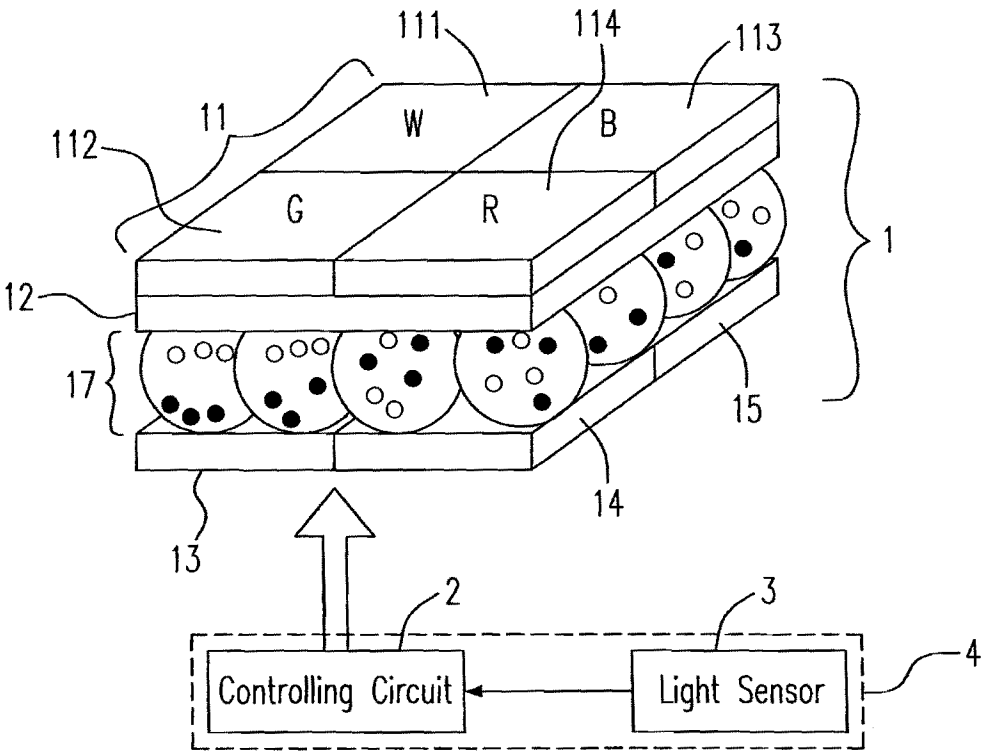
FIG. 1(A)~(E) is a diagram illustrating a single pixel of an embodiment according to the present application.
Figure 1D:
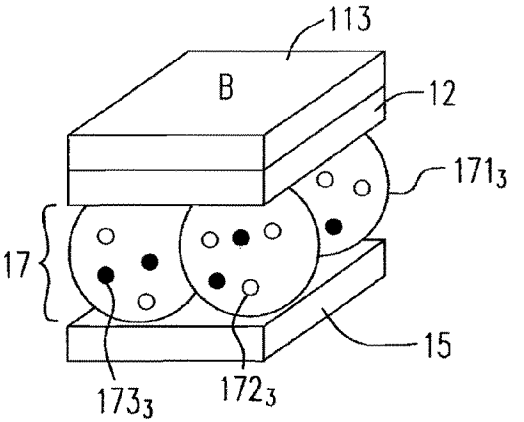

Please refer to FIG. 1(A), which is a structure diagram illustrating a single pixel 1 of an electro-phoretic display used in an embodiment according to the present application. The single pixel 1 of the electro-phoretic display includes a color filter 11, a first electrode layer 12, second electrode layers 13, 14, 15, 16, and an electrophoresis layer 17, wherein the second electrode layers 16 is not shown in FIG. 1(A), but in FIG. 1(B). The color filter 11 includes a white (W) photoresist area 111, a green (G) photoresist area 112, a blue (B) photoresist area 113 and a red (R) photoresist area 114, wherein the material of the W photoresist area 111 could be white or transparent photoresist. It is understandable for one skilled in the art that the configuration of the four photoresist areas are not limited to being respectively squared-shaped or to the 2-by-2 grid configuration in FIG. 1(A), but could be modified according to one's ingenuity, such as the side-by-side configuration in FIG. 2. The first electrode layer 12 is under the color filter 11 and is preferably a transparent electrode layer for avoiding impeding the entering and exiting of the external light. The electrophoresis layer 17 is configured under the first electrode layer 12. The second electrode layers 13, 14, 15 and 16 are configured under the electrophoresis layer 17, and the second electrode layers 13, 14, 15 and 16 have a substrate consisting of plastic or glass that is not shown in FIG. 1 (A), wherein the location of the second electrode layer 13 is configured to be corresponding to the G photoresist area 112, the location of the second electrode layer 14 is configured to be corresponding to the R photoresist area 114, the location of the second electrode layer 15 is configured to be corresponding to the B photoresist area 113, and the location of the second electrode layer 16 is configured to be corresponding to the W photoresist area 111. A brightness controller 4 adjusting the brightness of the pixel 1 is further included in FIG. 1(A) and electrically connected to the pixel 1, and a control circuit 2 and a light sensor 3 are included in the brightness controller 4 and electrically connected with each other. The control circuit 2 could drive the elements of the pixel 1 to control the color desired to display, or could receive the brightness value of the external environmental light (from the environment that the pixel 1 locates, for example) sensed by the light sensor 3 and thereby generates a controlling signal to control the brightness of the pixel 1.

Figure 1B:
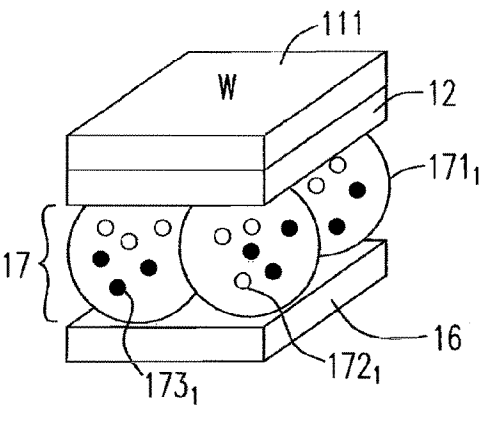
Figure 1E:
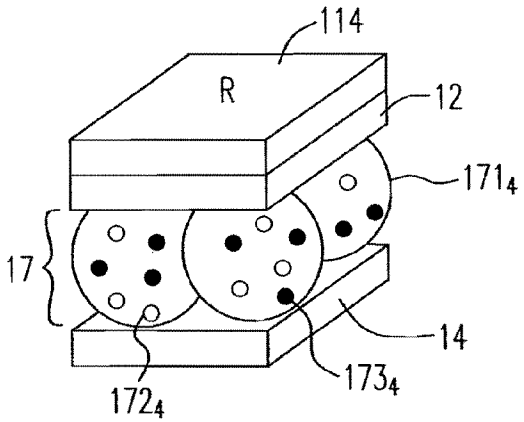
Figure 1C:
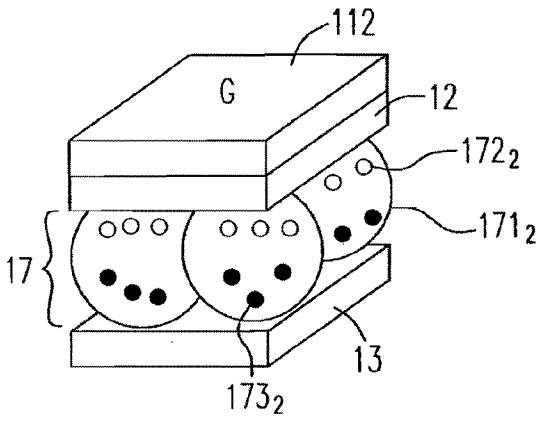
Figure 2:
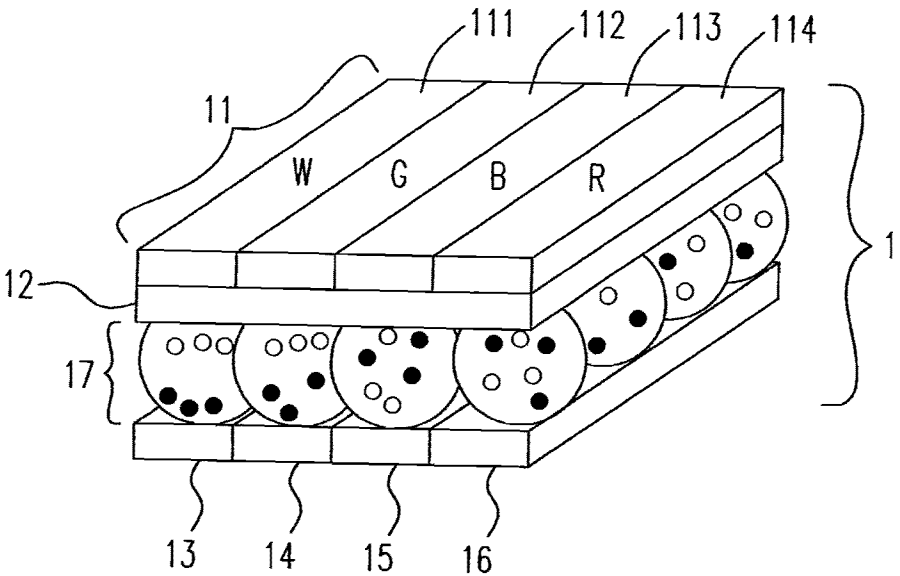
FIG. 2 is a diagram illustrating a single pixel of another embodiment.

Please refer to FIG. 1(B), which is a local diagram illustrating the W photoresist area 111 of the pixel 1 in FIG. 1(A). The electrophoresis layer 17 includes a plurality of capsules $\mathbf{171}_1$, and the plurality of capsules $\mathbf{171}_1$ includes a plurality of first particles $\mathbf{172}_1$ and $\mathbf{173}_1$. The plurality of first particles $\mathbf{172}_1$ are preferably white particles, whose material is preferably $TiO_2$, and have positive electric charges. The plurality of first particles $\mathbf{173}_1$ are preferably black particles and have negative electric charges. The second electrode layer 16 is under the electrophoresis layer 17. Please keep on referring to FIG. 1(C)~(E), which are local diagrams respectively illustrating the G, B and R photoresist areas of the pixel 1 in FIG. 1(A). The electrophoresis layer 17 includes a plurality of capsules $\mathbf{171}_2$, $\mathbf{171}_3$ and $\mathbf{171}_4$ respectively corresponding to the G, B and R photoresist areas. The plurality of capsules $\mathbf{171}_2$ include a plurality of second particles $\mathbf{172}_2$ and $\mathbf{173}_2$. The plurality of capsules $\mathbf{171}_3$ include a plurality of second particles $\mathbf{172}_3$ and $\mathbf{173}_3$. The plurality of capsules $\mathbf{171}_4$ include a plurality of second particles $\mathbf{172}_4$ and $\mathbf{173}_4$. The plurality of second particles $\mathbf{172}_2$~$\mathbf{472}_4$ are preferably white particles having positive electric charges, and the plurality of second particles $\mathbf{173}_2$~$\mathbf{173}_4$ are preferably black particles having negative electric charges.

When the external environmental light enters the color filter 11, only the red light of the external environmental light is allowed to pass through the R photoresist area 114, only the green light of the external environmental light is allowed to pass through the G photoresist area 112, only the blue light of the external environmental light is allowed to pass through the B photoresist area 113, and the whole external environmental light is completely allowed to pass through the W photoresist area 111. Therefore, the displayed color of the pixel 1 could be controlled by adjusting the locations of the plurality of first particles $\mathbf{172}_1$ and $\mathbf{173}_1$, and the plurality of second particles $\mathbf{172}_2$~$\mathbf{172}_4$ and $\mathbf{173}_2$~$\mathbf{173}_4$. For example, if the red color is required to be displayed by the pixel 1, a controlling signal is transmitted to the pixel 1 by the controlling circuit 2 to change a voltage (or a electric field) across the first electrode layer 12 and the second electrode layer 14 so as to change the locations of the plurality of second particles $\mathbf{172}_4$ and $\mathbf{173}_4$ in the capsules $\mathbf{171}_4$. If the plurality of second particles $\mathbf{172}_4$ are white and the plurality of second particles $\mathbf{173}_4$ are black, the plurality of second particles $\mathbf{172}_4$ are moved approaching the first electrode layer 12 and the plurality of second particles $\mathbf{173}_4$ are moved approaching the second electrode layer 14 by changing the voltage. In addition, the electric fields (or voltages) separately across electrode layers 12 and 16, electrode layers 12 and 13 and electrode layers 12 and 15 are also changed by the control circuit 2 such that the plurality of first particles $\mathbf{172}_1$ and the plurality of second particles $\mathbf{172}_2$ and $\mathbf{172}_3$ in the capsules $\mathbf{171}_1$~$\mathbf{171}_3$ are respectively moved approaching the second electrode layers 16, 13 and 15, and that the plurality of first particles $\mathbf{173}_1$ and the plurality of second particles $\mathbf{173}_2$ and $\mathbf{173}_3$ are moved approaching the first electrode layer 12. In this way, the red light passing through the R photoresist area 114 would be reflected by the plurality of second particles $\mathbf{172}_4$, and then passes through the R photoresist area 114 again and enters the human eyes. The light passing through the G, B and W photoresist areas 112, 113 and 111 would be absorbed by the plurality of first particles $\mathbf{173}_1$ and the plurality of first particles $\mathbf{173}_2$ and $\mathbf{173}_3$. As a result, the red color is displayed by the pixel 1. It could be derived from the above-mentioned example by one skilled in the art that the structure of pixel 1 in FIG. 1(A) could display three colors, red, green and blue, by the above-mentioned principle. Alternatively, the electric field (or the voltage) could be adjusted to change the amount of particles approaching the first electrode layer 12 or the second electrode layers 13, 14, 15 and 16 so as to display a color mixed by the three colors with any specific weights or the color depth thereof.

The brightness of the pixel 1 in FIG. 1(A) could be adjusted via the brightness controller 4 with the control circuit 2 and the light sensor 3. When the external environmental light changes, the light sensor 3 in the brightness controller 4 could detect such change. A threshold value would be set, such that an adjusting signal controlling the brightness is sent to the control circuit 2 by the light sensor 3 so as to adjust the brightness of the pixel 1 when the light sensor 3 detects that the brightness of the external environmental light is lower than the threshold value. After the adjusting signal received by the control circuit 1, the plurality of first particles $\mathbf{172}_1$ corresponding to the W photoresist area 111 are adjusted to approach the first electrode layer 12 according to the adjusting signal. The adjusting manner is changing the electric field (or the voltage) across the second electrode layer 16 and the first electrode layer 12 so as to increase the amount of the white first particles $\mathbf{172}_1$ having positive electric charges approaching the first electrode layer 12, which is near the display side (or the display surface) of the pixel 1, and increase the amount of the black first particles $\mathbf{173}_1$ having negative electric charges approaching the second electrode layer 16. Because the electric charges of the first particles $\mathbf{172}_1$ are opposite to those of the second particle $\mathbf{173}_1$, if the electric field (or voltage) across the second electrode layer 16 and the first electrode layer 12 is changed to move the black first particles $\mathbf{173}_1$ having negative electric charges approaching the second electrode layer 16, the white first particles $\mathbf{172}_1$ having positive electric charges would also be relatively assisted to move approaching the first electrode layer 12. With the increment of the white first particles $\mathbf{172}_1$ approaching the first electrode layer 12, the reflected white lights are relatively getting more, and the brightness of the pixel 1 would be increased accordingly. The white second particles $\mathbf{172}_2$~$\mathbf{172}_4$ and $\mathbf{172}_2$~$\mathbf{172}_4$ in the other area are not adjusted, therefore, the hues displayed by the pixel 1 would not be influenced.

Figure 3:
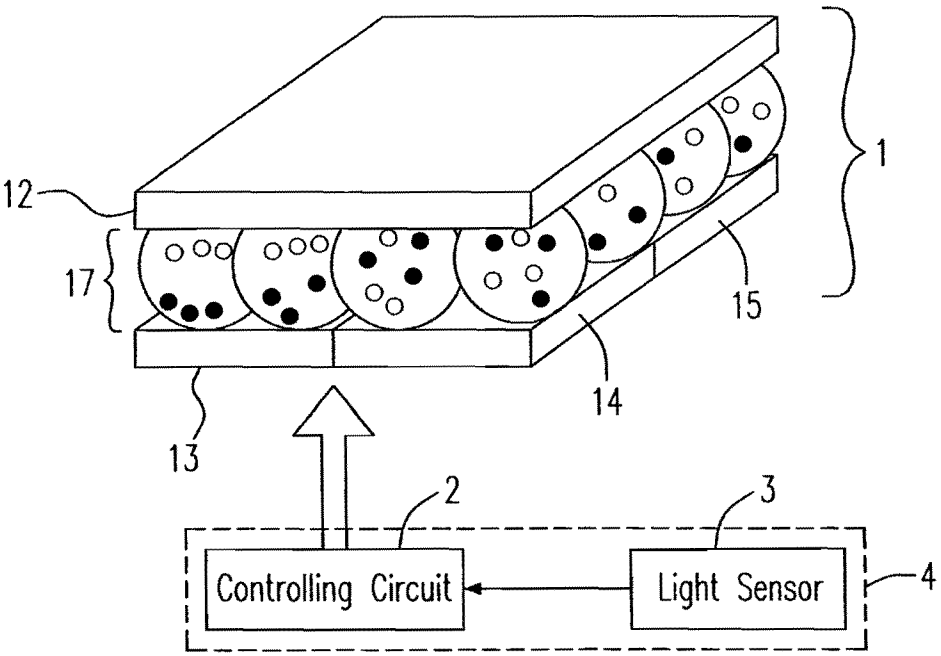
FIG. 3 is a diagram illustrating a single pixel of another embodiment according to the present application.

Please refer to FIG. 3, which illustrates another embodiment in the present invention. The structure of this embodiment does not include the color filter 11, however, color particles are used for displaying the hues in a frame. The numeral references of the other elements and particles are identical to those in FIG. 1. The colors of the plurality of second particles $\mathbf{172}_2$~$\mathbf{172}_4$ are preferably green, blue and red respectively, the plurality of first particles $\mathbf{172}_1$ are preferably white, and the plurality of first particles $\mathbf{173}_1$ and the plurality of second particles $\mathbf{173}_2$~$\mathbf{173}_4$ are preferably black. When the colors are displayed by the pixel 1, the plurality of first particles $\mathbf{172}_1$ and $\mathbf{173}_1$ and the plurality of second particles $\mathbf{172}_2$~$\mathbf{172}_4$ and $\mathbf{173}_2$~$\mathbf{173}_4$ are adjusted approaching to or being away from the first electrode layer 12 by the control circuit 2. The colors of the particles are reflected by the external environmental light so as to display a color mixed by the three colors, red, green and blue, with any specific weights or the color depth thereof.

When the external environmental light changes, the brightness controller 4 could detect that the brightness of the external environmental light is lower than a threshold value by the light sensor 3, and an adjusting signal controlling the brightness is sent to the control circuit 2 by the light sensor 3. The electric field (or the voltage) across the second electrode layer 16 and the first electrode layer 12 is changed by the control circuit 2 in the brightness controller 4 according to the adjusting signal so as to adjust the plurality of white first particles $\mathbf{172}_1$ and the plurality of black first particles $\mathbf{173}_1$. The plurality of white first particles $\mathbf{172}_1$ are adjusted so as to increase the amount of the plurality of white first particles $\mathbf{172}_1$ approaching the first electrode layer 12, which is near the display side of the pixel 1. The plurality of black first particles $\mathbf{173}_1$ are adjusted so as to increase the amount of the plurality of black first particles $\mathbf{173}_1$ approaching the second electrode layer 16. With the increment of the white first particles $\mathbf{172}_1$ approaching the first electrode layer 12, the reflected white lights are relatively getting more, and the brightness of the pixel 1 would be increased accordingly. The second particles $172_2$~$172_4$ and $173_2$~$173_4$ in the other areas are not adjusted, therefore, the hues displayed by the pixel 1 would not be influenced.

Figure 4:
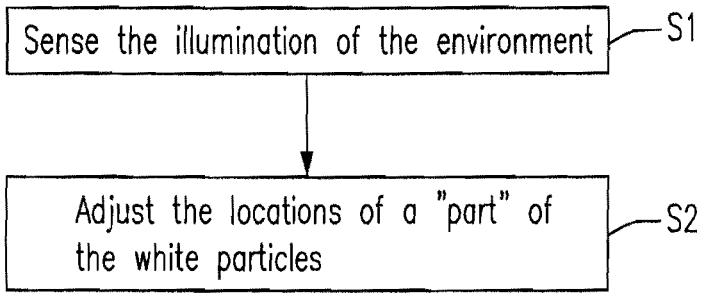
FIG. 4 is a flow chart corresponding to the embodiments according to the present application.

Please refer to FIG. 4, which is a flow chart for adjusting the brightness of the pixel 1 corresponding to the above-mentioned embodiments. For step S1, the brightness of the external environmental light is sensed and determined whether it is lower than a predetermined value (or a threshold value) or not. On the condition that the brightness of the external environmental light is lower than the predetermined value, a controlling signal is transmitted to a control circuit. In this step, the light sensor 3 of the above-mentioned embodiments could be used for sensing the brightness of the external environmental light. The control circuit could be the control circuit 2 of the above-mentioned embodiments, and the controlling signal could be transmitted to the control circuit 2 by the light sensor 3. For step S2, the locations of a "part" of the white particles in the pixel 1 are adjusted according to the controlling signal. For the embodiments according to the above-mentioned FIG. 1 (A)~(E) through FIG. 3, the "part" of white particles are the plurality of first particles $172_1$. The plurality of first particles $172_1$ in FIG. 1(B) is corresponding to the location of the W photoresist area 111. The plurality of first particles $172_1$ are moved approaching the first electrode layer 12, which is near the display side of the pixel 1, by the control circuit 2 such that much more external environmental lights could be reflected by the plurality of first particles $172_1$ so as to increase the brightness of the pixel 1. During the process of adjusting the plurality of first particles $172_1$, other particles, such as the second particles $172_2$~$172_4$ and $173_2$~$173_4$ according to the above-mentioned embodiments, would not be adjusted, therefore the hues of the pixel 1 would not be changed.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims, which are to be accorded with the broadest interpretation so as to encompass all such modifications and similar structures.

What is claimed is:

1. A brightness adjusting method for a display device, comprising:

providing a pixel in the display device with a white photoresist area having a plurality of first particles, including a plurality of white particles corresponding to the white photoresist area, and at least a color photoresist area having a plurality of second particles corresponding to the color photoresist area; and adjusting only locations of a part of the plurality of white first particles corresponding to the white photoresist area while keeping unadjusted locations of the plurality of second particles to control a brightness of the display device so that a hue of the pixel is free from being changed.

2. The brightness adjusting method as claimed in claim 1, wherein the display device further comprises a control circuit, and the step of adjusting only locations of the plurality of first particles is performed by the control circuit.

3. The brightness adjusting method as claimed in claim 2, wherein the pixel further has a first and a second electrode layers corresponding to the white photoresist area, and an electrophoresis layer configured therebetween and having the plurality of first particles.

4. The brightness adjusting method as claimed in claim 3, wherein the first and the second electrode layers respectively have a first voltage and a second voltage, and the step of adjusting only locations of the plurality of first particles further comprises a step of: adjusting one of the first voltage and the second voltage via the control circuit so as to move the plurality of first particles.

5. The brightness adjusting method as claimed in claim 1, wherein the display device has a display surface, the plurality of first particles further include a plurality of black particles, and the step of adjusting only locations of the plurality of first particles further comprises steps of:

sensing an environmental brightness; and causing the plurality of white particles to approach the display surface and keeping the plurality of black particles away from the display surface when the environmental brightness is lower than a predetermined value.

6. A method for adjusting a brightness, comprising:

providing a pixel having a first area with a white photoresist area displaying a white color, at least a second area displaying a color other than white, a plurality of first particles including white particles corresponding to the first area, and a plurality of second particles corresponding to the second area;

obtaining an environmental brightness; and controlling only locations of a part of the white particles when to the environmental brightness is lower than a predetermined value while keeping uncontrolled locations of the plurality of second particles so as to adjust the brightness while keeping a hue of the pixel unchanged.

7. The method as claimed in claim 6, wherein the pixel has a display side, and the plurality of first particles further comprise at least one black particle.

8. The method as claimed in claim 7, wherein the step of controlling only locations of the plurality of particles further comprises a step of controlling the at least one white particle to approach the display side and the at least one black particle to move away from the display side for reflecting light to human eyes.

9. The method as claimed in claim 7, wherein the step of controlling only locations of the plurality of first particles further comprises a step of controlling the at least one white particle to move away from the display side and the at least one black particle to approach the display side for reducing light to human eyes.

10. The method as claimed in claim 6, wherein the second particles are selected from a group consisting of a plurality of red particles, a plurality of green particles and a plurality of blue particles.

11. The method as claimed in claim 6, wherein the pixel further has a plurality of capsules, and each of the plurality of capsules has at least one of the plurality of first particles.

12. An electro-phoretic display for displaying a pixel, comprising:

a first area with a white photoresist area displaying a white color;

at least a second area displaying a color other than the white color;

an electrophoresis layer having a plurality of first particles including a plurality of white particles and corresponding to the first area and a plurality of second particles corresponding to the second area; and a brightness controller controlling only locations of a part of the plurality of white particles according to an environmental brightness while keeping uncontrolled locations of the plurality of second particles so as to adjust a brightness of the electro-phoretic display while keeping a hue of the pixel unchanged.

13. The electro-phoretic display as claimed in claim 12, wherein the brightness controller further comprises a sensor sensing the environmental brightness.

14. The electro-phoretic display as claimed in claim 13 further comprising a display side, wherein the plurality of first particles further comprise a plurality of black particles, and the brightness controller causes the plurality of white particles to approach the display side and keeps the plurality of black particles away from the display side when the environmental brightness is lower than a predetermined value.

15. The electro-phoretic display as claimed in claim 12 further comprising a color filter having the white photoresist area corresponding to the first area.

16. The electro-phoretic display as claimed in claim 15, wherein the color filter further has one of a red photoresist area, a green photoresist area and a blue photoresist area corresponding to the second area.

17. The electro-phoretic display as claimed in claim 16, wherein the white, the red, the green and the blue photoresist areas are respectively squared-shaped.

18. The electro-phoretic display as claimed in claim 12, wherein the electrophoresis layer has a plurality of capsules, each of which has at least one of the plurality of first particles.

19. The electro-phoretic display as claimed in claim 12 further comprising a first and a second electrode layers corresponding to the first area, and the electrophoresis layer configured therebetween, wherein the brightness controller controls the locations of the plurality of first particles by adjusting a voltage across the first and the second electrode layers.

20. The electro-phoretic display as claimed in claim 12 being an electric paper.

* * * * *